United States Patent [19]

Attinello et al.

[11] Patent Number: 4,865,328

[45] Date of Patent: Sep. 12, 1989

[54] LOW-COST, EXPENDABLE, CRUSHABLE TARGET AIRCRAFT

[75] Inventors: John S. Attinello, Alexandria, Va.; David G. Rousseau, Germantown, Md.

[73] Assignee: The United States of America as represented by the Secretary of the Navy, Washington, D.C.

[21] Appl. No.: 590,384

[22] Filed: Mar. 16, 1984

[51] Int. Cl.[4] ..... F41J 9/08

[52] U.S. Cl. ..... 273/362

[58] Field of Search ..... 273/362, 360, 417, 424–426; 446/211, 212, 56; 343/18 B; 244/3.24, 3.16, 3.13; 102/374

[56] References Cited

U.S. PATENT DOCUMENTS

| | | | |
|---|---|---|---|
| 2,840,819 | 6/1958 | Mc Clellan | 343/18 B UX |
| 3,466,653 | 9/1969 | Rudduck et al. | 343/18 B |
| 3,687,398 | 8/1972 | Beuschel . | |
| 3,699,891 | 10/1972 | Kreuzer et al. . | |
| 3,785,293 | 1/1974 | Barr et al. . | |
| 3,902,683 | 9/1975 | Bilsbury . | |
| 3,916,795 | 11/1975 | Lemstra . | |
| 4,076,006 | 2/1978 | Breslow et al. | 446/212 X |
| 4,108,074 | 8/1978 | Billing, Jr. et al. . | |
| 4,114,885 | 9/1978 | Morrow | 273/424 |
| 4,119,036 | 10/1978 | Hayashi et al. . | |
| 4,131,248 | 12/1978 | Berglund | 244/3.16 |
| 4,222,573 | 9/1980 | Adler | 273/426 |
| 4,362,107 | 12/1982 | Romer et al. . | |
| 4,407,465 | 10/1983 | Meyerhoff | 244/3.16 |
| 4,479,655 | 10/1984 | Adler | 273/426 X |

OTHER PUBLICATIONS

Science Kit, Inc. Catalog 5-1981, Rocket Kit #69918.

*Primary Examiner*—Paul E. Shapiro

*Attorney, Agent, or Firm*—Luther A. Marsh

[57] ABSTRACT

An expendable drone aircraft to be used as a target for advanced weapons platforms is made of a lightweight crushable foam material. The drone is adapted to realistically converge upon the weapons platform so as to activate the tracking/fire control sensors thereof. A solid fuel rocket motor is encased in a non-metallic lightweight housing and is used to power the drone in free flight. A simple optical seeking device is used to input a signal to a guidance control system which directs the drone in free flight to converge upon the weapons platform. If the weapons platform fails to neutralize the drone during convergence thereon, the impact hazard of the drone is neutralized by the lightweight crushable foam material which acts to harmlessly absorb the kinetic energy of the drone thereby minimizing danger to equipment and personnel of the weapons platform.

1 Claim, 1 Drawing Sheet

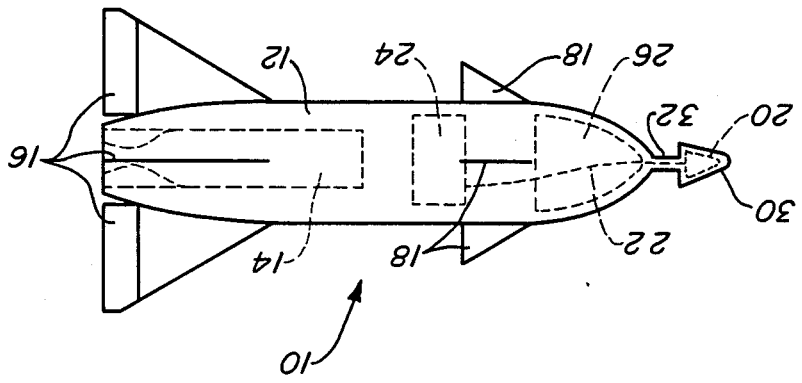
10
14
18
22
30
16
20
32
26
18
24
12

LOW-COST, EXPENDABLE, CRUSHABLE TARGET AIRCRAFT

BACKGROUND OF THE INVENTION

1. Field of the Invention

This invention relates to a target drone for a weapons system and more particularly to a lightweight, inexpensive target drone which minimizes danger to personnel and/or damage on impact.

2. Description of the Prior Art

It is important that weapons crews have realistic training exercises in order to meet combat readiness performance levels. Since the need for these skills may occur precipitously it is necessary to provide constant realistic training exercises so that weapons crews achieve and retain the requisite skills.

Weapons used as anti-missiles or anti-aircraft devices, either on ships or land have used a variety of targets to train their crews. One simple target is a banner towed by a non-target aircraft. Unfortunately, this is not a realistic target since it doesn't approach the weapon position realistically, i.e., safety considerations dictate that the banner cannot converge on the weapons platform. Even so, there is some danger for the pilot of the tow-aircraft.

Current weapons sytems, such as the Phalanx system are radar and computer controlled to ignore non-threatening targets, i.e., targets which are not on a converging course with the weapons platform. Accordingly, it is necessary to fly a target directly at the weapons platform rather than near it in order for such systems to become active. A drone currently used for that purpose is a BQM-74 which uses a jet engine and fuel and weighs approximately 400 pounds. If this drone flies parallel to the hereinabove described type of weapons system, it is ignored. If it flies at the weapons platform, it presents a serious danger to the weapon crew due to fire and impact hazards. In fact, one person was killed in just such an accident when a BQM-74 drone impacted his ship during training exercises on board the U.S.S. Antrium in February 1982. In addition to safety considerations, each BQM-74 drone costs over $130,000 apiece and hence is too expensive to be used very often.

Other target vehicles have been devised which have been formed of foamed plastic material or other lightweight material, such as are shown in U.S. Pat. Nos. 3,699,891 and 3,687,398. A foamed plastic body is formed around an aluminum rod in 3,699,891 to give structural strength to the rocket and support the rocket motor. A nose cone of cast iron is added to the front of the rocket as ballast material. While this device may be used as a target, it can't be used in a realistic approach to the weapon position because of its heavy mass and weapon-like construction. The aluminum road and cast iron nose cone would become lethal projectiles upon impact as would other solid parts of the device. Also, the plastic does not crush upon impact to absorb any of the kinetic energy of the target vehicle. Thus, this type of target is not considered suitable for realistic approaches, that is, convergent approaches upon the weapons platform.

Another target device shown is U.S. Pat. No. 3,687,398. This device flies apart into several pieces upon impact with the weapons platform. The nose cone is made of an elastic material to absorb some of the impact. This device has no guidance system and only follows a ballistic path toward the target. Thus, it does not always function as a realistic target and converge upon the weapon platform as is necessary. Furthermore, instead of crushing on impact, its constituent pieces fly off, increasing the danger to the weapons platform and personnel due to flying pieces. Accordingly also, this device is not considered suitable as a target drone for these weapons.

SUMMARY OF THE INVENTION

The present invention provides a target drone which can be realistically flown at a weapons platform without danger to the crew since it is lightweight, does not utilize liquid fuel and is crushable upon impact. The materials used in fabricating the present invention minimize danger to personnel upon impact. In addition, the relatively low cost of the device permits more frequent training exercises.

For example, each BQM-74C drone, as described hereinabove, ued in a training exercise costs more than $130,000, and this cost figure does not include the maintenance and support costs required for the drone. In contradistinction, each low cost, expendable crushable target aircraft according to the present invention is estimated to cost approximately $6,000, and the target vehicle according to the present invention requires no extraneous maintenance or support. The present invention can therefore provide a cost savings ratio of greater than 20:1 for each training exercise conducted, thus making more frequent, realistic training exercises economically feasible.

Accordingly, one object of the present invention is to provide a safe, crushable target drone for realistic training exercises for a weapon system.

Another object of the present invention is to provide an inexpensive target drone which is expendable for realistic training exercises for a weapon system.

A further object of the present invention is to provide a lightweight target drone which is relatively harmless upon impact with the weapon platform.

A still further object of the present invention is to provide a realistic target drone which is safe to operate near a manned weapon system.

Another object of the invention is to provide a safe, realistic, lightweight, expendable, crushable target drone.

Other objects, advantages and new features of the invention will become apparent from the following detailed description of the invention when considered in conjunction with the accompanying drawings wherein:

BRIEF DESCRIPTION OF THE DRAWING

The FIGURE shows a schematic representation of the present invention.

DETAILED DESCRIPTION OF THE PREFERRED EMBODIMENT

Referring now to the FIGURE wherein the overall arrangement of the present invention is shown as including a rocket-powered drone target shown generally as 10. The body 12 of the drone 10 is formed from lightweight crushable energy-absorbing foam material such as a polyurethane foam, the foam material selected to provide predetermined structural characteristics which ensure integrity in flight and the capability to absorb the kinetic energy of the drone 10 upon impact, while being lightweight enough to allow free flight and to avoid danger upon impact. The body 12 is shown in the preferred embodiment as being rocket-shaped and may be of any size large enough to be seen by the weapon and hold the requisite elements described hereinbelow, but otherwise should be as small as possible to minimize excess weight and impact damage potential. For example, it may have a wing span of 12 inches and an axial length of 36 inches. Other shapes are also possible, such as an airplane shape with two wings and a tail.

The drone 10 includes a single rocket motor 14 which uses solid propellant inside a rocket motor case to provide boost and sustainer thrusts. Solid rocket motors are well known to those skilled in the art and will not be further described herein except for those characteristics thereof unique to the present invention. The case is made of a lightweight material to minimize hazards should impact occur. For example, it could be made of fiberglass with a carbon nozzle insert. Other possible materials are phenolic/paper and rubber. A typical size for the rocket motor 14 would be 28 inches in length and 4 inches in diameter. Such a device will provide approximately 150 pounds of boost thrust for 2 seconds and 25 pounds of sustainer thrust for 60 seconds.

Four tail wings 16 (only three of which are shown) are made from molded foam and provide aerodynamic stability for the drone 10 in free flight. Fixed flaps (not shown) may be included in the wings.

Four movable canards 18 (only three of which are shown), also made of molded foam, are included toward the front of the drone 10. They may be moved under the control of a guidance control device 24 to direct the drone 10 toward a target, i.e., weapons platform.

A passive optical seeker means 20 is placed in front of the drone 10 in a separate aerodynamically stabilized head piece 30 spaced apart from the main rocket body 12 and connected thereto by a rod-shaped neck section 32. A passive seeker means requires that an electromagnetic signal be transmitted from the weapons platform to activate the seeker means 20 and serve as a homing signal therefor. This results in lower costs, complexity, weight and size of the drone 10. Alternatively, the seeker means 20 may be disposed on the forward nose section of the main rocket body 12. The first alternative is preferable since it is simpler, lighter, and less expensive than other systems. This seeker means 20 may be similar to devices currently used in laser guided bombs.

A fiber optic cable 22 connects the seeker means 20 to a guidance control device 24 and transmits an optical signal thereto. In response to signals picked up by the seeker means 20 and transmitted by the cable 22, the guidance control device 24 moves the canards 18 to direct the flight of the drone 10. Solid state circuitry is utilized for weight and size reduction.

Since most of the materials used in fabricating the drone 10 are transparent to radar waves, it may be necessary to include corner reflectors or half wavelength dipoles 26 in the form of commercially available metal foil chaff or wire cut to length and disposed in the foam material when the body 12 is cast. The metal included would be in very fine pieces and lightweight so as not to produce a safety hazard upon impact.

In operation, a laser or monochromatic light source is positioned near or below the weapon implacement and is preferably reflected from a metal plate. The seeker means 20 detects this light and the guidance control device 24 directs the drone 10 such that it converges upon the reflected light source. In some applications the metal reflecting plate may not be needed.

The drone 10, which weighs about 20 pounds, may be launched from the ground or from the air toward the weapon placement. After launch, the optical guidance system 20, 22, 24 seeks the light emitted by the target and the drone 10 homes in on it. The drone 10 approaches the weapon and becomes visable to its gun-control radar due to reflection from dipoles 26. Since the drone 10 is converging upon the weapon, the gun system becomes operative and attempts to destroy the drone 10. If the drone 10 is hit, it is easily destroyed. If the crew misses the drone 10, it converges upon the light emitted by the target and impacts upon the illuminated metal plate.

Upon impact, the foam body 12 of the drone 10 crushes, thereby absorbing the kinetic energy of the rocket casing and other heavier parts. Since the whole drone 10 weighs only about 20 pounds, the total impact is minimal and not dangerous to the crew. In addition, the rocket motor 14, the heaviest part of the drone 10, is made of material which will disintegrate upon impact thereby being less dangerous than a metal engine. The other devices in the drone 10 are small enough that they are not dangerous upon impact. The drone 10 may be launched from a distance great enough so that the solid propellant is expended by the time it impacts and hence the drone is inert during its final convergence upon the weapons platform.

The total cost of the drone is considerably less than that of other devices due to its simple construction, light weight and lack of mechanical parts. As a result, it is economical to employ the drone according to the present invention on repeated training exercises so that weapon crew skills are kept at the desired level of combat readiness.

What is claimed is:

1. A flying drone for use as a target against a weapons platform comprising:

a body adapted for aerodynamic free flight fabricated from a predetermined crushable, lightweight foamed material, said body further comprising a aerodynamically stabilized head piece disposed forward of said body and adapted to house said guidance sensor, and a rod-shaped neck section interconnecting said aerodynamically stabilized head piece to said body, such that said aerodynamically stabilized head piece functions to isolate said guidance sensor from said body;

a rocket motor disposed in a rear portion of said body and made of a non-metallic, lightweight material;

a guidance sensor disposed in a forward portion of said body and adapted to detect a signal transmitted by said weapons platform; and a guidance system connected to said guidance sensor and acting in response thereto to control a flight path of said drone to realistically converge upon said weapons platform;

whereby upon impact with said weapons platform, said body crushed harmlessly and acts to absorb kinetic energy of said flying drone so as to prevent damage to said weapons platform.

* * * * *